US006367389B1

(12) United States Patent
Westrom

(10) Patent No.: US 6,367,389 B1
(45) Date of Patent: Apr. 9, 2002

(54) CARTRIDGE FOR A FIREARM

(76) Inventor: Mark A. Westrom, 100 ½ N. State St., #2, Geneseo, IL (US) 61254

( * ) Notice: Subject to any disclaimer, the term of this patent is extended or adjusted under 35 U.S.C. 154(b) by 0 days.

(21) Appl. No.: 09/426,285

(22) Filed: Oct. 25, 1999

(51) Int. Cl.[7] ..... T42B 3/08
(52) U.S. Cl. ..... 102/470; 102/467; 102/470
(58) Field of Search ..... 102/470, 467; 42/42.02, 69.01, 70.88, 41

(56) References Cited

U.S. PATENT DOCUMENTS

| | | | | | |
|---|---|---|---|---|---|
| 27,933 | A | | 4/1860 | Smith et al. | |
| 62,283 | A | * | 2/1867 | Millbank | 102/470 |
| 102,675 | A | * | 5/1870 | Gatling | 102/470 |
| 121,808 | A | | 12/1871 | Payne | |
| 125,640 | A | | 4/1872 | Wesson | |
| 172,716 | A | | 1/1876 | Dimock | |
| 268,601 | A | * | 12/1882 | Bailey | 102/470 |
| 592,942 | A | | 11/1897 | Tichenor | |
| 692,154 | A | | 1/1902 | Lammadin et al. | |
| 933,030 | A | * | 8/1909 | Funk | 102/470 |
| 1,082,975 | A | * | 12/1913 | Rylands | 102/470 |
| 1,345,565 | A | | 7/1920 | Thompson | |
| 1,461,013 | A | | 3/1923 | Hodge | |
| 2,379,056 | A | * | 6/1945 | Alexander | 102/470 |
| 2,522,208 | A | | 9/1950 | Catlin | |
| 2,793,455 | A | | 5/1957 | Wignall | |
| 3,050,894 | A | | 8/1962 | Ivy | |
| 3,786,761 | A | | 1/1974 | Ciccone et al. | |
| 4,316,341 | A | | 2/1982 | Landry | |
| 4,424,638 | A | * | 1/1984 | Hillberg | 42/69.01 |
| 4,615,133 | A | | 10/1986 | Center | |
| 4,848,237 | A | | 7/1989 | Zedrosser | |
| 4,955,157 | A | | 9/1990 | Brighton et al. | |
| 5,490,463 | A | | 2/1996 | Lamberty et al. | |

FOREIGN PATENT DOCUMENTS

| | | | | |
|---|---|---|---|---|
| AU | 403856 A1 | * | 10/1969 | 102/470 |

* cited by examiner

*Primary Examiner*—Michael J. Carone
*Assistant Examiner*—Lulit Semunegus
(74) *Attorney, Agent, or Firm*—Woodard, Emhardt, Naughton, Moriarty & McNett

(57) ABSTRACT

The present invention relates to a cartridge for use with firearms capable of firing 0.22 caliber rimfire cartridges. The cartridge includes a bullet connect to a casing. The casing includes a cylindrical wall that extends to an end member opposite the bullet and a hollow interior formed by the wall and the end member. A flange extends radially outwardly from the cylindrical wall at the end member. A projection connected with the wall extends inwardly into the hollow interior. A recess for receiving priming composition is formed by the projection and the end member. A firing pin configured for firing the cartridge of the present invention is also provided.

25 Claims, 5 Drawing Sheets

CARTRIDGE FOR A FIREARM

BACKGROUND OF THE INVENTION

The present invention relates generally to the field of firearms, and more particularly, but not exclusively, to an improved cartridge design and firing pin for the same.

The most popular cartridge used when firing a firearm is the 0.22 caliber rimfire cartridge. Rimfire ammunition is often used because it is relatively inexpensive as compared to center fire ammunition. Thus, rimfire ammunition allows greater use of the firearm with less cost for such activities as recreational shooting, weapons training, hunting, and the like. Rimfire ammunition may also be used with firearms that conventionally fire more expensive ammunition, such as military weapons. These types of weapons may be adapted to fire the lower cost rimfire ammunition during training exercises with the firearm, thus saving on training expense.

One example of a rimfire cartridge is illustrated in FIG. 1 and designated generally at 10. Rimfire cartridge 10 includes a bullet 12 connected to a casing 14 at crimped portion 17. Opposite bullet 12, the casing 14 has a rearward end member 16. Casing 14 also includes a wall 22 having an inner surface 22*a* and an outer surface 22*b*. Wall 22 and end member 16 define a hollow interior 24. Projecting radially outward from wall 22 and extending between wall 22 and end member 16 is annular outer rim 18. Outer rim 18 defines an annular pocket 20 communicating with hollow interior 24. As is well known in the art, when the cartridge 10 is manufactured, a quantity of fluid priming composition 28 is spun into annular pocket 20 and allowed to dry. A quantity of powder 26 is then placed within hollow interior 24 of casing 14. In order to fire the cartridge, a firing pin configured to sharply strike casing 14 at outer rim 18 crushes the priming composition in annular pocket 20 which in turn ignites powder 26. Powder 26 burns rapidly and creates gas as it burns. The pressure from the gas forces bullet 12 from crimped portions 17 and propels bullet 12 down the barrel of the firearm.

One of the drawbacks with such rimfire cartridges is that casing 14 suffers from low strength and is prone to failure, particularly at rim 18, when casing 14 is used for a high velocity cartridge. Thus, even though the capacity of casing 14 can hold a sufficient quantity of powder to produce a high velocity cartridge, casing 14 will fail due to the higher pressures generated by the larger quantity of burning powder. This results in less powder being used with the cartridge to minimize the risk of casing failure. The reduced amount of powder causes less gas pressure to be generated by the burning powder. This in turn lowers the velocity and the energy of the bullet when it is fired.

There remains a need for a cartridge which effectively addresses the problems of casing strength while maintaining the advantages associated with rimfire cartridges. The cartridge should be capable of use in existing firearms with minimum modification to its components. The present invention is directed towards meeting these needs, among others.

SUMMARY OF THE INVENTION

One form of the present invention is directed to a cartridge that includes a casing having a wall and a projection extending inwardly from the wall adjacent the end member of the cartridge. The projection and the end member of the casing form a recess for priming composition to be placed therein.

According to one aspect of the invention, a cartridge for a firearm is provided. The cartridge includes a bullet coupled to a casing. The casing includes a cylindrical wall that extends from a first end to an end member opposite the bullet. A hollow interior is formed by the wall and the end member. A flange extends radially outwardly from the cylindrical wall at the end member. A projection connected with the wall extends radially inwardly into the hollow interior. A recess for receiving priming composition is formed by the projection and the end member.

According to another aspect of the invention, a method for making a cartridge for a firearm is provided. The method includes (a) providing a casing with a cylindrical wall and a length extending between a first end and an end member, a hollow interior defined by the wall and end member, and a flange adjacent the end member that extends radially outwardly from the cylindrical wall; (b) forming a projection that extends from the wall into the hollow interior such that the projection and the end member form a recess; and (c) placing priming composition in the recess. In one embodiment, the method further includes (d) placing powder in said hollow interior; and (e) placing a bullet in the first end of the casing.

According to yet another aspect of the invention, a method for making a cartridge for a firearm is provided. The method includes: (a) providing a casing having a centerline axis and a cylindrical wall about the axis that has a length extending between a first end and an a end member, the wall and end member defining a hollow interior, and the cylindrical wall having an inner surface that is spaced a first distance from the centerline axis; (b) forming a recess in the interior of the casing by placing a projection on the cylindrical wall so that the recess is spaced a second distance from the centerline axis that is less than the first distance; and (c) placing priming composition in the recess.

According to a further aspect of the invention, a firing pin for a firearm is provided. The firing pin includes a body having a centerline axis extending between a rearward end and a striking end of the body. The striking end has a leading point spaced a first distance from the centerline axis so that it strikes a cartridge having a priming composition recess spaced a corresponding distance from the centerline of the cartridge casing. The striking end also includes a trailing point spaced the second distance from the axis to strike an outer rim of a rimfire cartridge.

These and other forms, embodiments, aspects, features and objects of the invention will be apparent from the following description of the preferred embodiments.

DESCRIPTION OF THE PREFERRED EMBODIMENTS

Figure 1:
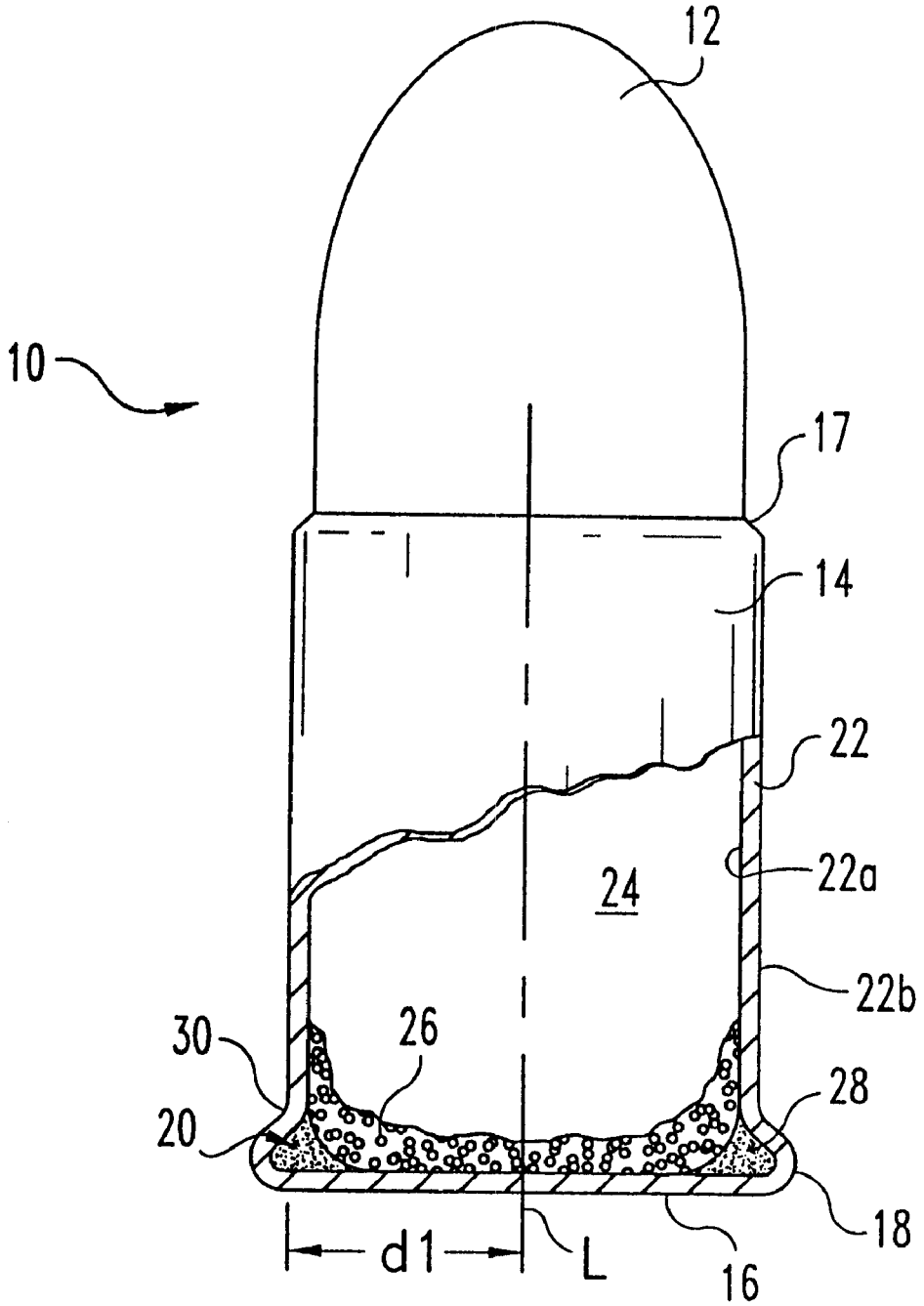
Fig. 1 (PRIOR ART)
FIG. 1 is a partial elevation and partial section view of a prior art rimfire cartridge.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any such alterations and further modifications in the illustrated device, and any such further applications of the principles of the invention as illustrated therein are contemplated as would normally occur to one skilled in the art to which the invention relates.

Figure 2:
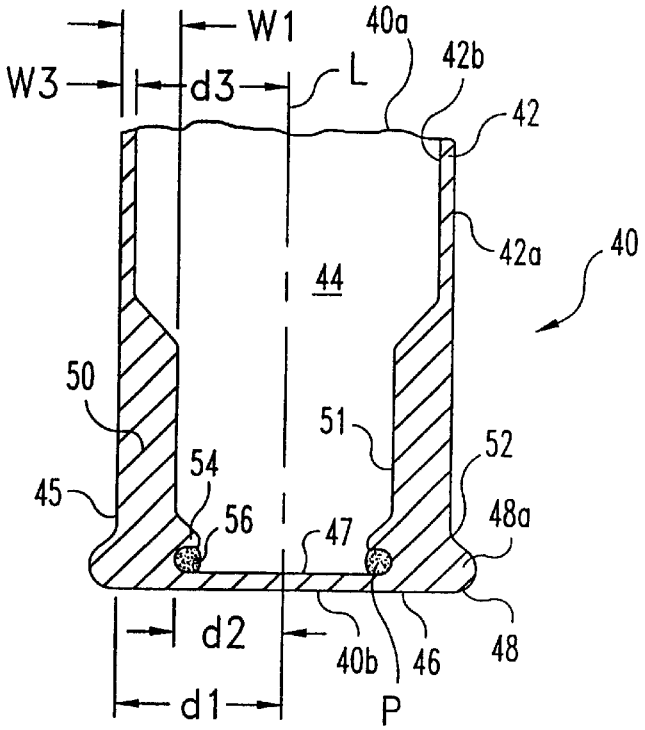
FIG. 2 is a partial cross-sectional view of a casing of a cartridge according to the present invention.

Referring now to FIG. 2, there is illustrated a partial section view of a casing for a firearm cartridge according to the present invention. Casing 40 is of generally cylindrical configuration about centerline axis L and includes a wall 42 having outer surface 42*a* and inner surface 42*b*. Wall 42 has a thickness w3 and inner surface 42*b* is spaced a distance d3 from axis L. Wall 42 has a thickened wall segment 50 extending along at least a portion of the wall 42. Thickened segment 50 has an inner surface 51, and a width w1 that is greater than width w3 of wall 42. It is also contemplated herein that wall 42 may have a thickness that corresponds to w1 along a substantial portion of its length. It is further contemplated that wall 42 may taper in width from w3 to w1 along the length of wall 42.

Casing 40 has first end portion 40*a* opposite end portion 40*b*. End portion 40*b* is configured to provide cup 45 terminating in end member 46. A flange 48 is formed adjacent to end member 46, and extends between the end member 46 and thickened wall segment 50. Flange 48 extends away from centerline axis L and radially outwardly from wall 42, forming an annular lip 48*a* with outer surface 42*a*. In a most preferred embodiment, flange 48 is a solid rim that reinforces casing 40 in the region of cup 45 where wall 42 meets end member 46, and does not define a folded annular pocket, unlike the casing of FIG. 1. The present invention also contemplates a casing that does not include a flange forming an annular lip with the casing.

Wall 42 and cup 45 define hollow interior 44. Projection 54 extends from inner surface 51 of thickened wall segment 50 to form a recess 56 on the inner surface of the wall. Recess 56 is positioned between end member 46 and projection 54. Recess 56 receives and retains priming composition p that is placed therein. Priming composition p may be spun or otherwise placed into recess 56 using techniques known to those skilled in the art. In a preferred embodiment, projection 54 and recess 56 each annularly extend around and encircle centerline axis L. Relative to cartridge 10 of FIG. 1, casing 14 has an annular pocket 20 formed by outer rim 18 that is spaced a distance d1 from centerline axis L of the casing 14. In contrast, recess 56 of casing 40 is spaced a distance d2 from centerline axis L, the distance d2 being less than distance d1. In a most preferred form, the distance d2 is also less than distance d3 from the centerline axis L to the inner wall surface 42*b* of wall 42.

Figure 3:
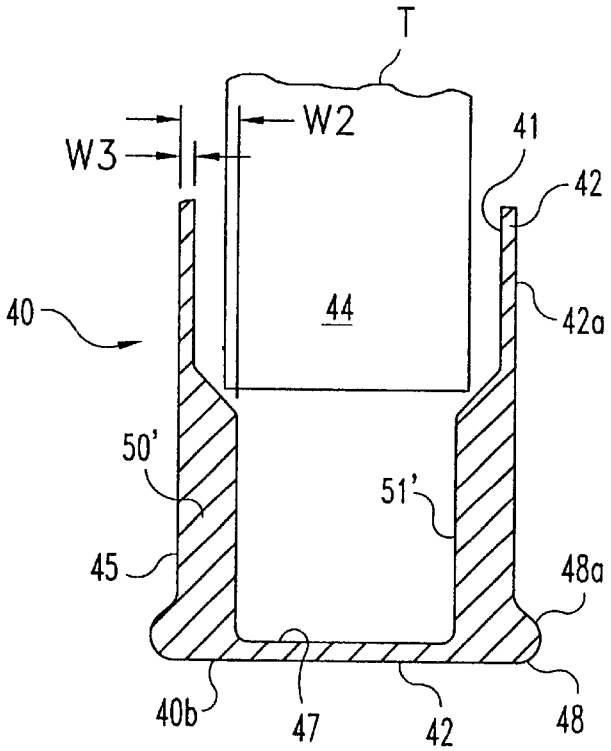
FIG. 3 is a partial cross-sectional view of the casing of FIG. 2 prior to forming the projection in the casing.

Referring now to FIG. 3, casing 40 is illustrated without projection 54 on the wall 42. Thickened wall segment 50' has a thickness w2 which is greater than thickness w1 of wall segment 50. In this embodiment, projection 54 is formed by displacing a portion of the thickened wall segment 50' through plastic deformation. In one form, this deformation takes place by inserting a tool T through opening 41 having a dimension corresponding to w1. Tool T is centered with respect to centerline axis L and advanced towards end member 46 to broach a portion of cup 45 and form projection 54 where its advancement stops. Correspondingly, the material is displaced a sufficient distance downward and in sufficient quantity to form projection 54 at the desired location above bottom surface 47, thus creating recess 56 as shown in FIG. 2. In other embodiments, a different machining or formation technique may be utilized to provide projection 54 that may or may not use casing 40 in the FIG. 3 configuration.

Figure 4:
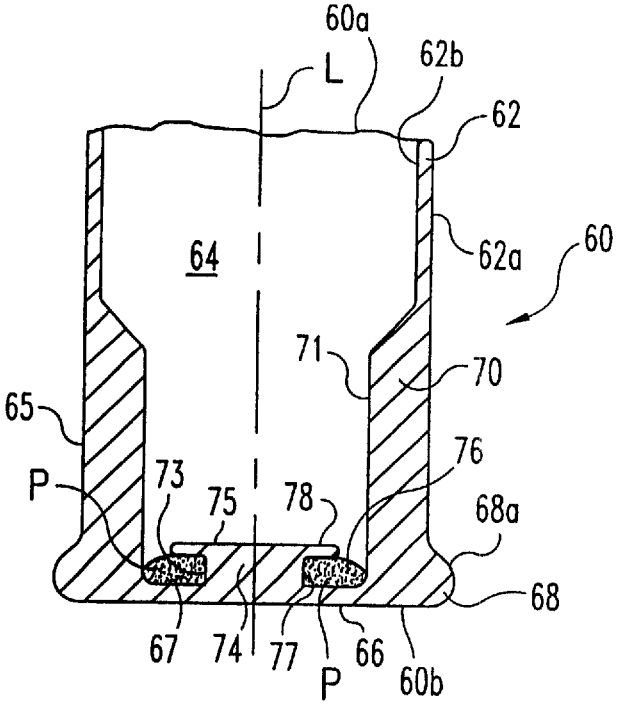
FIG. 4 is a partial cross-sectional view of the casing of another embodiment cartridge according to the present invention.

Referring to FIG. 4, there is illustrated another embodiment of a casing for a firearm cartridge according to the present invention. Wall 62 extends from first end portion 60*a* to end portion 60*b* of casing 60. Wall 62 has outer surface 62*a* and inner surface 62*b*. Wall 62 includes a thickened segment 70 having an inner surface 71. End portion 60*b* is configured to provide cup 65 terminating in end member 66. The wall 62 and end member 66 define hollow interior 64. A flange 68 is formed adjacent to end member 66, and extends between the end member 66 and thickened wall segment 70. Flange 68 extends away from centerline axis L and radially outwardly from wall 62, forming an annular lip 68*a* with outer surface 62*a*. In a most preferred embodiment, flange 68 is solid to reinforce casing 60 in the region of cup 65 where wall 62 meets end member 66.

Figure 5:
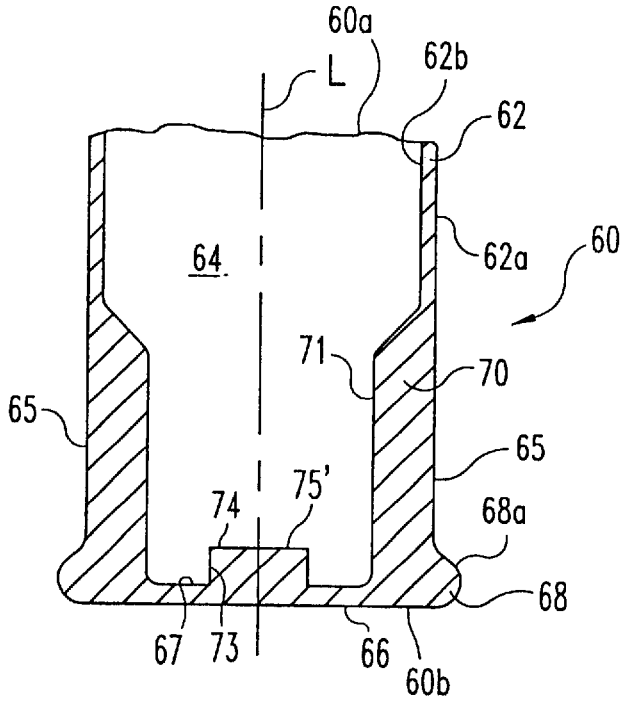
FIG. 5 is a partial cross-sectional view of the casing of FIG. 4 prior to forming the projection in the casing.

End member 66 has inner bottom surface 67. Casing 60 includes a post 74 with first end 73 connected to bottom surface 67. First end 73 is preferably integrally formed with end member 66. Referring to FIG. 5, a second end or top 75 of post 74 is deformed by a compression load, thermal technique, or other method to define projection 78 that extends radially outwardly around post 74 at top 75. Projection 78 defines a recess 76 between it and end member 66. In this embodiment, priming composition p may be placed to rest in the bottom of cup 65 on end member 66 before formation of projection 78.

Figure 6:
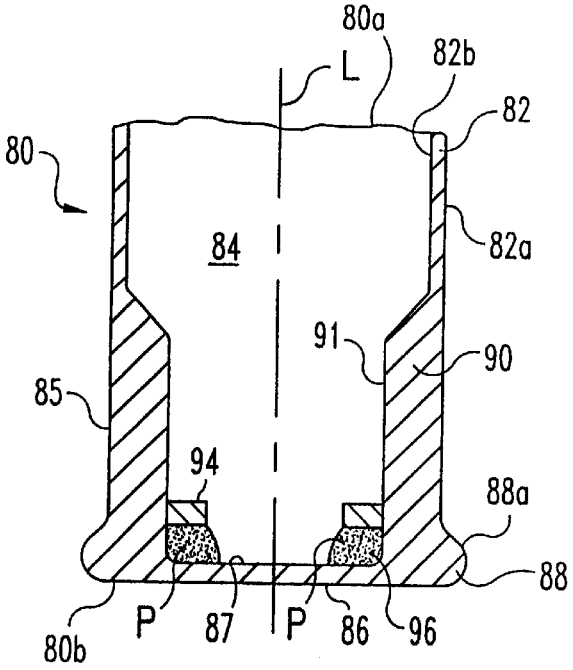
FIG. 6 is a partial cross-sectional view of the casing of a further embodiment cartridge according to the present invention.

In FIG. 6, there is shown a further embodiment of a casing for a firearm cartridge according to the present invention. Casing 80 includes wall 82 having outer surface 82*a* and inner surface 82*b*. Wall 82 also includes thickened segment 90 extending along at least a portion of the length of the wall. Casing 80 has end portion 80*a* opposite end portion 80*b*. End portion 80*b* is configured to provide cup 85 terminating in end member 86. A flange 88 is formed adjacent to end member 86, and extends between the end member 86 and thickened wall segment 90. Flange 88 extends away from centerline axis L and radially outward from wall 82, forming an annular lip 88*a* with outer surface 82*a*.

Wall 82 and end member 86 define hollow interior 84. A projecting member 94 is inserted into hollow interior 84 and positioned adjacent end member 86 so that extends radially into hollow interior 84. Projecting member 94 is connected to inner wall surface 91 of thickened portion 90, and forms recess 96 on the wall 82. Recess 96 is formed between ring 94 and end member 86. Ring 94 may be connected to wall 82 using any one of a number of techniques, such as, for example, welding, applying an adhesive, or applying heat treatment. In one embodiment, ring 94 and recess 96 extend annularly and encircle centerline axis L. In other embodiments, ring 94 and recess 96 are formed along only a portion of wall 82 in cup 85.

It should be appreciated that casings 60, 80 of FIGS. 4 and 6 have a recess for receiving priming composition p positioned at a distance from centerline axis L of the casing that is less than the distance d1 of the prior art rimfire cartridge. As described above with respect to FIGS. 2–3, this distance is also preferably less than the distance d3 measured between centerline axis L and the inner wall surface of the casing.

Among the advantages realized by the present invention is that the flange and thickened wall portion provide increased strength to the casing as compared to prior art rimfire cartridges. The present invention thus allows casing 14 to be loaded with pressures normally associated with higher velocity center-fire cartridges. The ability to increase the pressure in the casings of the present invention allows the cartridge to fire a bullet with a greater velocity and energy with reduced failures or "blow-outs." Release of propellant gases from the cartridge ejector are also reduced since the flange and thickened wall portion increase the strength of the casing where the ejector cut in the firearm bolt supports the cartridge. The present invention also enables the use of powder and priming composition designed to generate higher gas pressures and bullet velocities than are attainable with prior art rimfire cartridges.

Figure 7:
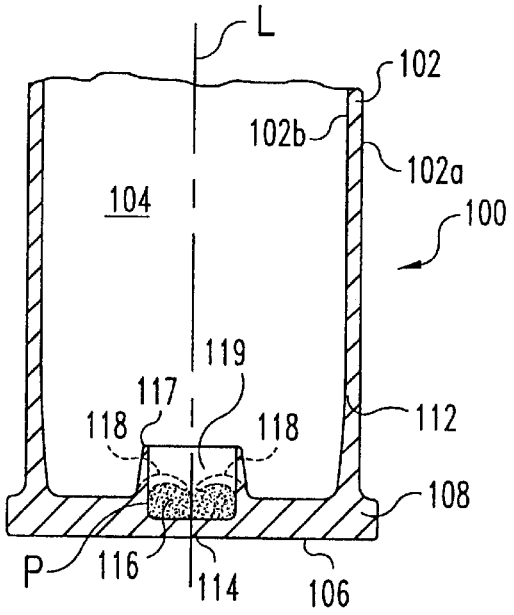
FIG. 7 is a partial cross-sectional view of the casing of a cartridge according to another aspect of the present invention.

Referring now to FIG. 7, there is illustrated a casing for a center fire cartridge according to another aspect of the present invention. Center fire cartridge 100 includes wall 102 having an outer surface 102*a* and inner surface 102*b*. Casing 100 defines hollow interior 104 for holding powder therein. A centerline axis L extends through casing 100. Casing 100 has end member 106 and a flange 108 formed with thickened wall portion 112 and end member 106. A priming composition pocket 116 is formed in end member 106 in communication with hollow interior 104. End member 106 has a reduced thickness portion 114 at priming pocket 116. Reduced thickness portion 114 is positioned on axis L for striking with center-fire firing pin. A cup 117 extends upwardly from end member 106 into hollow interior 104 around reduced thickness portion 114. Cup 117 is crimped or otherwise deformed to form two or more anvil portions 118, and preferably three anvil portions 118. The anvil portions 118 are deformed so that each of the two or more anvil portions 118 are positioned over priming pocket 116.

When a firing pin strikes reduced thickness portion 114, the priming composition in priming composition pocket 116 is crushed between reduced thickness portion 114 and anvil portions 118. This detonates the priming composition, which then flashes through opening 119 between the anvil portions 118. The priming composition flash then ignites the powder and the bullet is fired. The cartridge of FIG. 7 is advantageous over other center fire cartridges since, among other reasons, it is not necessary to place a relatively expensive primer cup assembly in the end member of the casing, which is subject to gas leakage between the primer cup and primer pocket formed in the casing.

Figure 8:
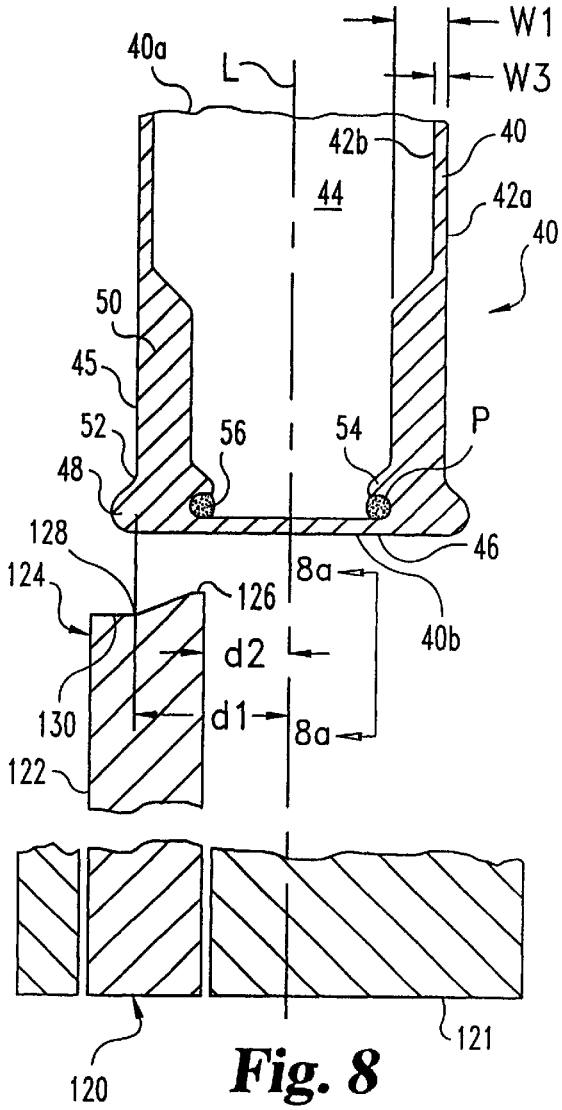
FIGS. 8 and 8*a* are partial cross-sectional views of the casing of FIG. 2 with a firing pin according to another aspect of the present invention.
Figure 8A:
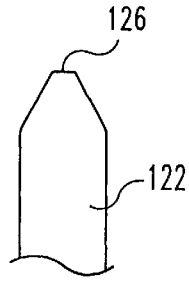

Referring now to FIG. 8, another aspect of the present invention is illustrated. A firing pin 120 is provided that is configured to detonate the priming compositions of the cartridges of the present invention in addition to prior art rimfire cartridges. The barrel and details of bolt 121 of the firearm are not shown but are known and understood by those skilled in the art. Firing pin 120 has a body 122 having a configuration like the body of any firing pin known to those skilled in the that is used to fire 0.22 caliber rimfire cartridges. Firing pin 120 also has a striking end 124. Striking end 124 has leading tip 126, positioned at a distance d2 from centerline axis L. Leading tip 126 terminates in a wedge-shaped point. Striking end 124 forms a chisel point, as shown in FIG. 8*a*, that extends from leading tip 126 to trailing tip 128. Trailing tip 128 is positioned a distance d1 from centerline axis L. In one form, a shoulder 130 extends axially from trailing tip 128 a sufficient distance such that the shoulder 130 contacts the rearward wall of the bullet chamber housing the cartridge when the firearm is discharged.

For the purposes of clarity, firing pin 120 is shown adjacent casing 40. However, it should be understood that firing pin 120 also has application with the other embodiments of casings according to the present invention. As shown with respect to casing 40, when the cartridge having casing 40 is chambered in a firearm, firing pin 120 has leading tip 126 for contacting end member 46 such that end member 46 is pushed inward against projection 54. This crushes the priming composition disposed within recess 56 and causes it to detonate, which, in turn, ignites the powder placed within hollow interior 44. Trailing tip 128 is positioned such that if a prior art cartridge, such as cartridge 10 of FIG. 1, is chambered in the firearm instead of cartridge 40, trailing tip 128 strikes end member 16 at rim 18, crushing the priming composition 28 and causing it to detonate, which in turn ignites the powder in the casing. The leading tip 126 when striking a prior art rimfire cartridge pushes the end member 16 into the bore 24 at a distance d2 from axis L without detonating the priming composition until trailing tip 128 strikes the casing end member at rim 18.

Figure 9A:
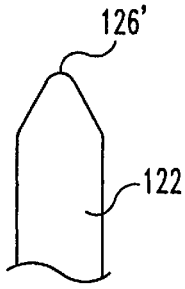
FIGS. 9 and 9*a* are partial cross-sectional view of another embodiment firing pin.
Figure 9:
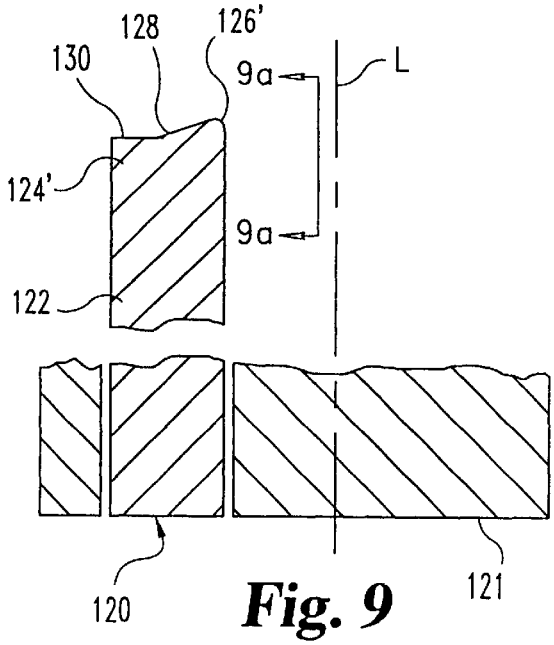

In FIG. 9, an alternate embodiment of firing pin 120 is designated at 120'. Firing pin 120' is similar to firing pin 120, however, striking end 124' has a leading tip 126' with a rounded profile forming a blunt nose. The rounded profile, shown in FIG. 9*a*, extends from leading tip 126' to trailing tip 128'.

It should be understood that the present invention also contemplates the use of a firing pin that is designed solely to strike the end member of the cartridge at a distance d2 from the centerline axis L of the cartridge. It should also be understood that such a firing pin could be used in conjunction with a firing pin selector so that the user of the firearm can selectively fire prior art rimfire cartridges, center fire cartridges, or cartridges with casings according to the present invention.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A firearm cartridge, comprising:

a casing including:

a generally cylindrical wall having a length extending between a first end and an end member;

a hollow interior formed by said wall and said end member;

a projection forming an annular ring around said wall extending radially inwardly from said wall into said hollow interior, said projection being spaced apart from said end member along said wall to define a recess; and priming composition in said recess.

2. The cartridge of claim 1, further comprising a flange extending radially outwardly from said cylindrical wall at said end member.

3. The cartridge of claim 2, wherein said flange is solid.

4. The cartridge of claim 3, wherein said flange forms an annular lip extending outwardly about said wall adjacent said end member.

5. The cartridge of claim 1, further comprising a bullet connected to the casing at the first end.

6. The cartridge of claim 1, wherein said wall has an inner surface and said annular ring is continuous about said inner surface.

7. The cartridge of claim 1, wherein said wall has a thickened lower segment extending from said end member along at least a portion of the length of said wall.

8. The cartridge of claim 7, wherein said annular ring is on an inner surface of said thickened wall segment.

9. A firearm cartridge, comprising:

a casing including:

a generally cylindrical wall having a length extending between a first end and an end member;

a hollow interior formed by said wall and said end member;

a pedestal in said hollow interior having a first end and a second end, said first end adjacent said end member and said second end having a projection extending radially outwardly from said second end of said pedestal into said hollow interior, said projection being spaced apart from said end member along said wall to define a recess; and priming composition in said recess.

10. The cartridge of claim 9, further comprising a flange extending radially outwardly from said cylindrical wall at said end member.

11. The cartridge of claim 10, wherein said flange is solid.

12. The cartridge of claim 9, further comprising a bullet connected to the casing at the first end.

13. The cartridge of claim 9, wherein said projection forms an annular ring around said pedestal.

14. A method for making a firearm cartridge, comprising:

providing a casing having a cylindrical wall extending between a first end and an opposite end member, the wall and the end member defining a hollow interior, the casing further including a flange adjacent the end member extending radially outwardly from the cylindrical wall;

forming an annular ring around the wall, the annular ring projecting inwardly into the hollow interior;

placing priming composition in a recess formed between the annular ring and the end member; and placing powder in the hollow interior.

15. The method according to claim 14, further comprising placing a bullet in the first end of the casing.

16. The method according to claim 14, wherein providing a casing includes providing the casing with a thickened wall segment extending from the end member along at least a portion of the length of the wall of the casing.

17. The method according to claim 16, wherein forming the annular ring includes displacing a portion of the thickened wall segment towards the end member.

18. A method for making a firearm cartridge, comprising:

providing a casing with a cylindrical wall extending between a first end and an end member, the casing having a centerline axis extending therethrough, the casing further including a hollow interior defined by the wall and the end member, the cylindrical wall having an inner surface spaced a first distance from the centerline axis;

forming a recess in the hollow interior by placing an annular ring around said inner wall surface, the recess spaced a second distance from the centerline axis, the second distance being less than the first distance; and placing priming composition in the recess.

19. The method according to claim 18, further comprising placing powder in the hollow interior.

20. The method according to claim 18, wherein providing a casing includes providing the casing with a thickened wall segment extending from the end member along at least a portion of the length of the wall.

21. The method according to claim 20, wherein forming a recess includes displacing a portion of the thickened wall segment towards the end member.

22. A firing pin for a firearm, comprising:

a body having a centerline axis, said body extending between a rearward end and a striking end, said striking end having a leading point spaced a first distance from said centerline axis to strike a cartridge having a priming composition recess positioned between the centerline axis and a location spaced a second distance from said centerline axis, said striking end further including a trailing point spaced the second distance from said axis to strike an outer rim of a rimfire cartridge.

23. The firing pin of claim 22, wherein said striking end further includes a shoulder extending outwardly from said trailing point.

24. The firing pin of claim 22, wherein said leading point is in the shape of a wedge.

25. The firing pin of claim 22, wherein said leading point is in the shape of a rounded nose.

* * * * *